United States Patent [19]

Goi

[11] Patent Number: 4,518,158

[45] Date of Patent: May 21, 1985

[54] GUIDE FOR USE IN A BANK NOTE HANDLING MACHINE

[75] Inventor: Kowichi Goi, Tokyo, Japan

[73] Assignee: Laurel Bank Machine Co., Ltd., Tokyo, Japan

[21] Appl. No.: 332,948

[22] Filed: Dec. 21, 1981

[30] Foreign Application Priority Data

Dec. 27, 1980 [JP] Japan ..... 55-191596[U]

[51] Int. Cl.[3] ..... B65H 5/08

[52] U.S. Cl. ..... 271/9; 271/12; 271/312

[58] Field of Search ..... 271/9, 12, 272, 273, 271/274, 275, 307, 311, 312, 313, 308, 303, 305

[56] References Cited

U.S. PATENT DOCUMENTS

| | | | |
|---|---|---|---|
| 2,261,707 | 11/1941 | Welk | 271/272 |
| 3,108,680 | 10/1963 | Ellis | 271/303 |
| 3,661,383 | 5/1972 | Morrison | 271/303 X |
| 3,713,735 | 1/1973 | Wilber | 271/272 X |
| 4,017,068 | 4/1977 | McKee | 271/275 |
| 4,066,253 | 1/1978 | Lundblad | 271/9 X |
| 4,209,249 | 6/1980 | Clark | 271/9 X |
| 4,363,584 | 12/1982 | Kokubo | 271/9 X |

*Primary Examiner*—Richard A. Schacher
*Attorney, Agent, or Firm*—Perman & Green

[57] ABSTRACT

Bank notes are drawn out of containers provided in a bank note handling machine into first paths and then delivered therefrom to a second path through a junction where each of the first paths joins the second path. A guide is positioned at the junction. The guide is made in a comb-like form which has an upper portion curved upwardly and throughout the whole width-length of the bank note and a plurality of depending members. Notches are defined between the depending members to be adapted to cause rollers and belts of the first path to project therethrough.

3 Claims, 5 Drawing Figures

GUIDE FOR USE IN A BANK NOTE HANDLING MACHINE

BACKGROUND OF THE INVENTION

This invention relates to a guide for use in a bank note handling machine, such as a bank note disbursement machine. More particularly, it relates to a guide at the junction of conveyance paths for bank notes which is provided in a bank note handling machine.

Conventionally, as shown in FIG. 1*a*, there has been provided a junction station 9 where a plurality of first paths 2 (only one of which is shown) join a second path 3. The first path is formed by rollers 5 and belts 6 which deliver to the junction 9 bank notes S drawn, one at a time, out of the bank note container C provided in the bank note disbursement machine. The second path 3 is formed by a belt 8 and rollers, not shown, so as to receive the bank notes from the first paths and convey the same to an accumulating station, not shown, for disbursement.

At the junction 9, as shown in FIG. 1*b*, there has been provided a plurality of guide members 4*a* which are parallel with and along the width length of the bank note S. The guide member 4*a* has a curved portion 12 provided at its end along the roller 5 to smoothly deliver and guide the bank note S from one of the first paths 2 to the second path 3.

However, on the delivery of the bank note S from one of the first paths 2 to the second path 3, as the leading end of the bank note S has reached the curved portions 12 of the guide members 4*a*, the bank note S simultaneously engages with the belts 8 and guide members 4*a* to take a corrugated form, as shown in dotted lines in FIG. 1*b*. Consequently, the bank note S becomes rigid in the direction of the second path 3 and, therefore, it becomes difficult to cause the bank note S to be curved toward the direction of the second path 3.

In such a construction, as the bank note S advances further, it strikes against the belt 8 and the leading end of the bank note S is apt to be damaged due to its rigidity.

SUMMARY OF THE INVENTION

It is, therefore, an object of the present invention to provide a guide for use in a bank note handling machine which eliminates the above-mentioned disadvantages.

According to the present invention, there is provided a guide for guiding bank notes from a first path to a second path in a bank note handling machine in which bank notes are taken, one at a time, in first paths each formed by a plurality of rollers and belts and delivered therefrom to a second path formed by a plurality of rollers and belts through a junction where the first paths join the second path, characterized in that the guide is made in a comb-like form which has an upper portion curved upwardly and throughout the whole width-length of the bank note, and a plurality of depending members integral with the curved portion, a notch being defined between the depending members to allow the rollers and the belt of the first path to project therethrough.

DESCRIPTION OF THE DRAWINGS

Other objects and advantages of the present invention will become apparent from the following description made with reference to the accompanying drawings, in which.

DESCRIPTION OF THE PREFERRED EMBODIMENT

One embodiment of the present invention will now be described in detail with reference to the accompanying drawings.

Figure 1A:
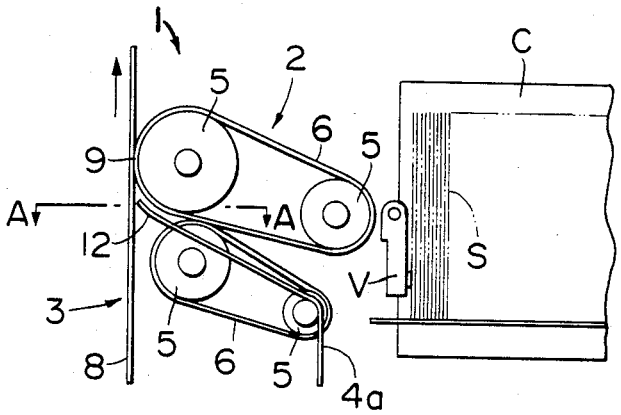
FIG. 1a (PRIOR ART)
FIG. 1*a* is a side view showing a conventional junction for bank note paths of a bank note handling machine.
Figure 1B:
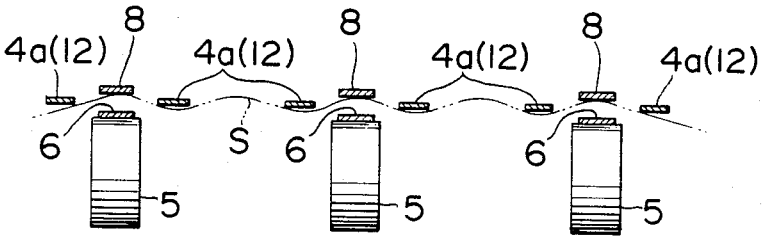
FIG. 1b (PRIOR ART)
FIG. 1*b* is a cross-sectional view taken along line A—A of FIG. 1*a;*

Similar parts as those in FIG. 1 will be indicated by like reference numerals.

Figure 4:
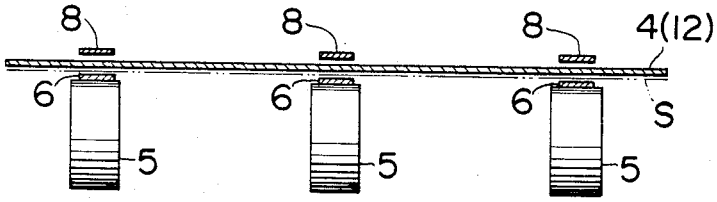
FIG. 4 is a cross-sectional view taken along line B—B of FIG. 3.
Figure 2:
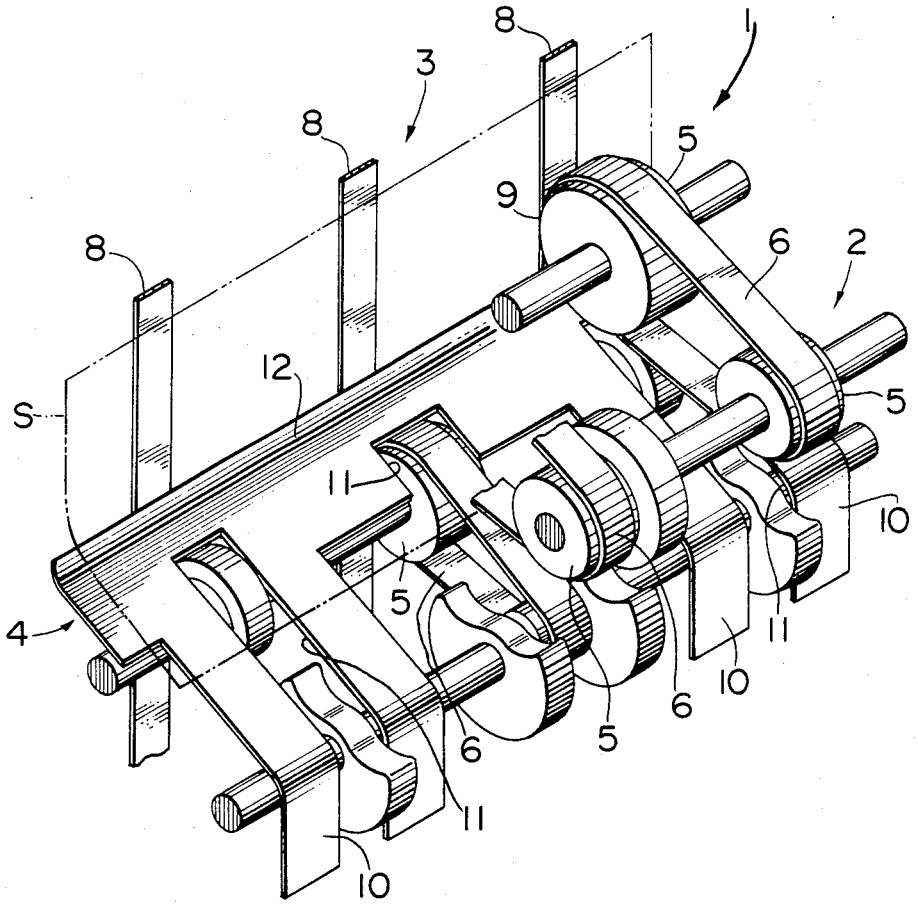
FIG. 2 is a perspective view showing a junction for bank note paths of a bank note handling machine according to the present invention.
Figure 3:
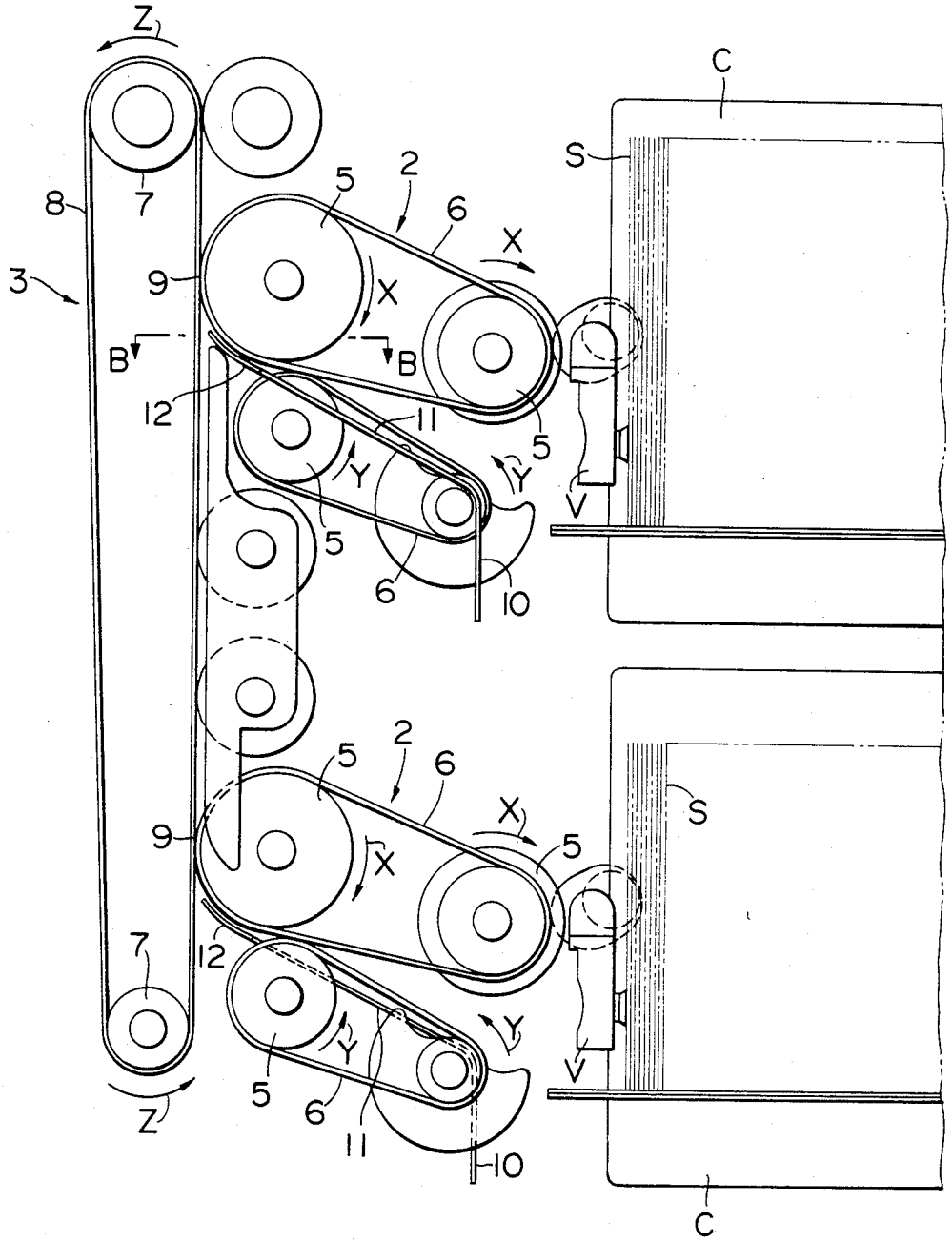
FIG. 3 is a side view of FIG. 2.

Referring to FIGS. 2 to 4, there is shown one embodiment according to the present invention in which a delivery mechanism 1 comprises a plurality of first paths 2, a second path 3 and a plurality of guides 4 each provided at the junction of one of the first paths 2 and the second path 3.

The first path 2 is formed by a plurality of rollers 5, 5 which are divided into groups of roller pairs and a plurality of belts 6, each trained on a pair or rollers. The rollers 5 are drivingly connected to a driving source, not shown, so as to be rotated in the directions as indicated by arrows X and Y, respectively. In the first path, the rollers 5 and the belts 6 serve to convey or deliver to the junction where the first path joins the second path the bank notes drawn by a suction head V, one at a time, out of the bank note container C for accommodating a plurality of bank notes therein.

The second path 3 is formed by a plurality of rollers 7 and belts 8 trained on the rollers 7. The rollers 7 are adopted to be rotated in the direction as indicated by the arrow Z in synchronism with the running speed of the belts 6 in the first path. In the second path, the rollers 7 and the belts serve to receive the bank notes from the first path at the junction 9 and to convey the same to the accumulating station, not shown.

The above-mentioned guide 4 is made in a comb-like form which has a plurality of depending members, each terminating in a vertical member 10. Notches 11 are defined between the depending members to allow the rollers 5 and the belts 6 to project therethrough. The guide member 4 has an upper portion 12 curved upwardly and throughout the whole length of the bank note S.

In operation, the bank note S which is drawn by the sucking head V out of the container C is taken into the space defined between the belts 6 in the first path 2. Then, the bank note S is delivered from the first path 2 through the junction 9 to the second path 3 while engaging with the members 10 and the curved portion 12 of the guide 4. At this time, the bank note S is caused to be smoothly curved along the curved portion 12 of the guide 4. Accordingly there is no possibility of the bank note S being damaged by striking against the belt 8 of the second path 3 at its leading end.

Then, the bank note S which has been delivered into the second path 3 is upwardly conveyed toward the accumulating station, not shown.

What is claimed is:

1. A guide for guiding bank notes from a first path having first conveyor means for conveying a bank note in a first direction to a second path having a second conveyor means to convey the bank note in a second direction, said second direction being different than said first direction in a bank note handling machine in which bank notes are taken, one at a time, in first paths each formed by a plurality of rollers and belts and delivered therefrom to a second path formed by a plurality of rollers and belts through a junction where the first paths join the second path, characterized in that the guide is stationarily disposed relative to said first conveyor means while guiding bank notes therebetween and made in comb-like form which has an upper portion curved upwardly and throughout the whole width-length of the bank note from the first direction to the second direction by causing the bank note to smoothly curve from the first direction to the second direction while being supported by the upper portion along its whole width and a plurality of depending members integral with the curved portion, said depending members being located closely adjacent said first conveyor means to guide the bank notes to the upper curved portion of the guide, said upper curved portion of the guide being located closely adjacent said first and second conveyor means to transfer the bank note along said first conveyor means to said second conveyor means, a notch being defined between the depending members to allow the rollers and the belts of the first path to project therethrough, said notch of said guide terminating at said upper curved portion closely adjacent the projecting rollers and belts of said first conveyor means whereby the bank note is smoothly guided along the guide and whereby there is no possibility of the bank note being damaged by striking against the second conveyor means.

2. In a bank note handling machine having a delivery mechanism comprising a plurality of first paths, having first conveyor means for conveying the bank note in a first direction a second path having second conveyor means for conveying the bank note in a second direction, said second direction being different than the first direction and a plurality of guides provided at the junction of one of the first paths and second path and means for feeding a bank note from a bin into the first path, the improvement comprising:

a comb-like guide mechanism stationarily disposed relative to said first and second conveyor means while guiding bank notes therebetween for supporting the bank note from underneath and delivering the leading edge of the bank note to the second path from the first path without damaging the leading edge of the bank note as it contacts the second path by causing the bank note to smoothly curve from the first direction to the second direction, the guide mechanism having an upper portion curved upwardly and throughout the entire width of the leading edge of the bank note as it is supported thereby and a plurality of depending members integral with the curved portion, said depending members being located closely adjacent said first conveyor means to guide the bank notes to the upper curved portion of the guide, said upper curved portion of the guide being located closely adjacent said first and second conveyor means to transfer the bank note along from said first conveyor means to said second conveyor means, a notch being provided between said depending members to allow for rollers and belts of said first path to project therethrough, said notch of said guide terminating at said upper curved portion closely adjacent the projecting rollers and belts of said first conveyor means whereby the bank note is smoothly guided along the guide and whereby the bank note is maintained in a non-corrugating dispostion along its width which is normal to the direction in which it is fed so that damage to the bank note is avoided due to the bank note striking against the second conveyor.

3. The machine as in claim 2 wherein the upper portion of the guide mechanism is smoothly curved upwardly whereby there is no possibility of the bank note being damaged by sticking against the second path of the delivery mechanism.

* * * * *